United States Patent [19]

Polney

[11] 4,095,320

[45] Jun. 20, 1978

[54] YARN TEXTURING AIR JET

[75] Inventor: Richard J. Polney, New Castle, Del.

[73] Assignee: Enterprise Machine and Development Corporation, New Castle, Del.

[21] Appl. No.: 775,692

[22] Filed: Mar. 9, 1977

[51] Int. Cl.[2] ..... D02G 1/16

[52] U.S. Cl. ..... 28/273

[58] Field of Search ..... 28/1.4, 273, 254

[56] References Cited

U.S. PATENT DOCUMENTS

| | | | |
|---|---|---|---|
| 3,010,270 | 11/1961 | Richmond et al. | 28/1.4 X |
| 3,188,713 | 6/1965 | Dyer et al. | 28/273 |
| 3,259,954 | 7/1966 | Dyer et al. | 28/273 X |
| 3,328,863 | 7/1967 | Cobb et al. | 28/1.4 |
| 3,380,242 | 4/1968 | Richmond et al. | 28/1.4 X |
| 3,545,057 | 12/1970 | Lubach | 28/273 |
| 3,577,614 | 5/1971 | Price | 28/1.4 |
| 3,863,309 | 2/1975 | Price | 28/1.4 |
| 3,881,231 | 5/1975 | Price et al. | 28/1.4 |
| 3,881,232 | 5/1975 | Price et al. | 28/1.4 |
| 3,969,799 | 7/1976 | Polney | 28/1.4 |
| 3,979,805 | 9/1976 | Hoffsommer et al. | 28/1.4 |

*Primary Examiner*—Robert R. Mackey

*Attorney, Agent, or Firm*—Bell, Seltzer, Park & Gibson

[57] ABSTRACT

This yarn texturing air jet is of the type which includes a venturi supported in the exit end of the jet housing with a yarn guiding needle positioned in the entrance end. The space between the venturi and the inner end of the needle defines a turbulence chamber and pressurized air passes along the needle and enters the turbulence chamber through a restricted airflow passageway extending completely around the inner end of the needle to impart crimps, curls and loops to the filaments of the yarn as the yarn passes through the turbulence chamber. In accordance with the present invention, a cut-away portion in the form of a beveled face is provided on the inner end of the needle for increasing the volume of air in an arcuate segment of the restricted airflow passageway so that a greater volume of air enters the turbulence chamber through the arcuate segment of the restricted airflow passageway to provide enhanced crimps, curls and loops and to permit texturing of the yarn at an increased rate of speed.

7 Claims, 5 Drawing Figures

YARN TEXTURING AIR JET

This invention relates generally to a yarn texturing air jet and more particularly to an improvement in the manner in which the air is directed into the turbulence chamber to enhance the crimps, curls and loops produced in the filaments of the yarn and to permit a faster and more economic operation.

The present invention is concerned particularly with yarn texturing air jets of the type having an elongate housing with a venturi supported in one end and a yarn guiding needle positioned in the other end. The venturi is provided with an inwardly tapering conical inner end wall which defines the exit end of a turbulence chamber. The normally flat inner end of the yarn guiding needle defines the entrance end of the turbulence chamber and an inwardly tapered inner end portion of the needle extends at least partially into and is centered within the inwardly tapering conical inner end wall of the venturi to define a restricted and uniform airflow passageway completely surrounding the inner end of the needle. Pressurized air is directed into the central bore of the jet and passes along the needle to enter the turbulence chamber in a uniformly distributed manner through the restricted airflow passageway surrounding the inner end of the needle to impart crimps, curls and loops to the filaments of the yarn as the yarn passes through the turbulence chamber. The uniform distribution of the air entering the turbulence chamber appears to limit the speed of operation and to limit the size and configuration of the crimps, loops and curls formed in the filaments of the yarn.

With the foregoing in mind, it is an object of the present invention to provide a yarn texturing air jet which provides means for increasing the volume of air entering the turbulence chamber in an arcuate segment of the restricted airflow passageway so that the yarn may be textured or bulked at a substantially higher speed than heretofore possible; provides more efficient use of the pressurized air; and enhances the crimps, curls and loops imparted to the filaments of the yarn.

In accordance with the present invention, the inner or exit end of the needle is provided with means for increasing the volume of air in an arcuate segment of the restricted airflow passageway so that the greater volume of air enters the turbulence chamber through the arcuate segment of the restricted airflow passageway. In the illustrated embodiment, the increase in the volume of air in an arcuate segment of the restricted airflow passageway is provided by a cut-away portion in the form of a beveled face on the inner end of the yarn guiding needle. While the air still enters the turbulence chamber through a restricted airflow passageway completely surrounding the inner end of the needle, the beveled face on the inner end of the needle permits a greater volume of air to enter the turbulence chamber through the arcuate segment provided by the beveled face so that the air enters the turbulence chamber in a nonuniform or unbalanced condition around the needle. This unbalanced air entry appears to increase the agitation which occurs in the turbulence chamber and thereby aids in creating a positive separation of the individual filaments of the yarn to permit the formation of well-defined crimps, curls and loops in the filaments of the yarn.

Other objects and advantages will appear as the description proceeds when taken in connection with the accompanying drawings, in which FIG. 1 is an isometric view of the yarn texturing air jet of the present invention;

Figure 2:
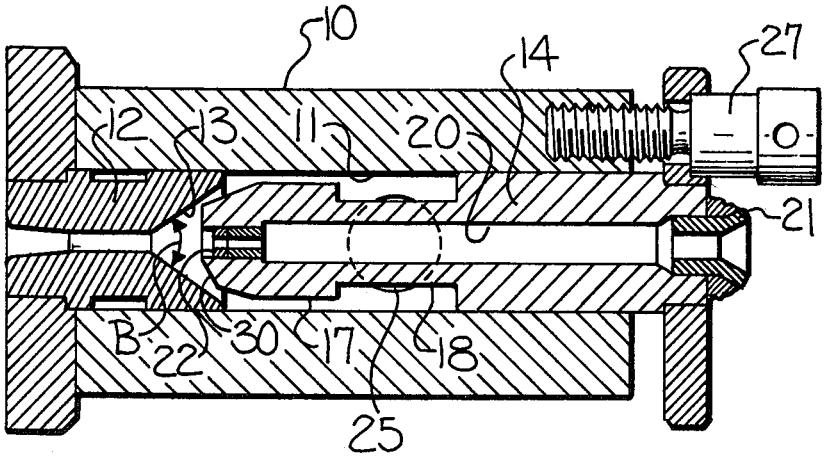
FIG. 2 is an enlarged longitudinal sectional view through the air jet of FIG. 1, taken substantially along the line 2—2 in FIG. 1.

The air jet includes an elongate housing 10 having a central bore 11 (FIG. 2) extending therethrough and from the entrance end to the exit end thereof. Venturi means is suitably supported in the exit end of the housing 10 and in the central bore 11 and includes a venturi 12 having an inwardly tapered conical inner wall 13 defining the exit end of a turbulence chamber. A yarn guiding needle 14 is positioned in the entrance end of the housing 10 and the main body portion of the needle 14 is of the same diameter as the central bore 11.

The inner end or end face 15 of the needle normally extends at right angles to the longitudinal axis of the needle 14 and defines the entrance end of the turbulence chamber. The yarn guiding needle 14 also includes an inwardly tapered inner end portion 16 extending at least partially into and centered within the inwardly tapered conical inner end wall 13 of the venturi 12 to define a restricted airflow passageway completely surrounding the inner end face 15. Thus, the restricted airflow passageway completely surrounding the inner end of the needle normally provides uniform entry of air into the turbulence chamber as the air passes over the end of the needle with a uniform volume of air completely therearound.

The needle 14 is illustrated as being provided with a relatively large cylindrical portion 17 immediately adjacent the inwardly tapered inner end portion 16 and a reduced cylindrical portion 18 between the cylindrical portion 17 and the main body of the needle 14. However, it is to be understood that the inner end of the needle may be of the same diameter throughout, thereby eliminating the reduced cylindrical portion 18.

Figure 1:
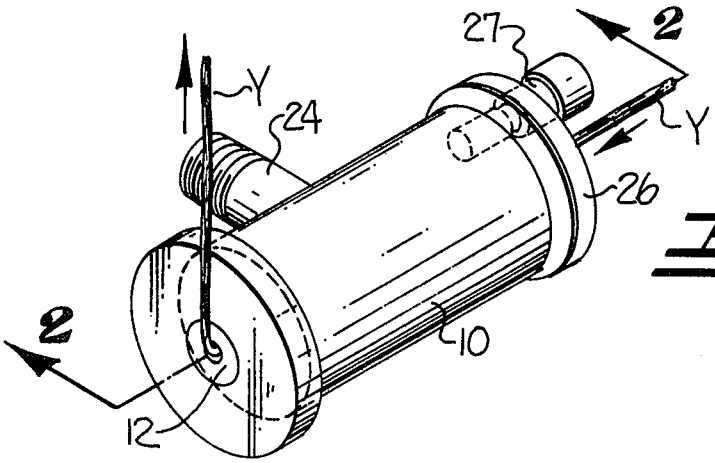
Figure 4:
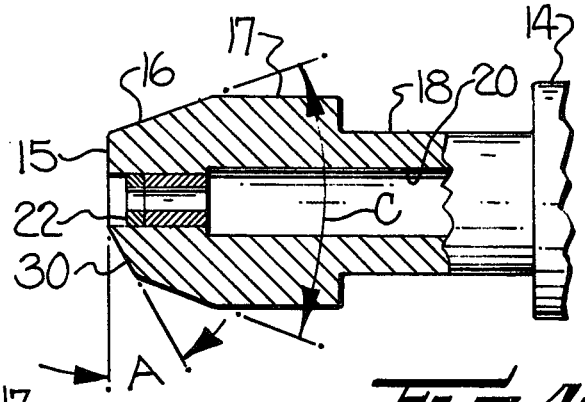
FIG. 4 is a fragmentary vertical sectional view taken substantially along the line 4—4 in FIG. 3.

A yarn passageway 20 extends along the longitudinal axis and through the needle 14 and provides an exit opening in the inner end 15 of the needle. A ceramic yarn guide 21 may be provided in the entrance end of the yarn passageway 20 and a sapphire guide 22 may be provided in the exit end of the yarn passageway 20 of the needle 14 (FIG. 4). Means is provided for directing pressurized air into the central bore 11 so that the air passes along the needle and enters the turbulence chamber through the restricted airflow passageway around the inner end 15 of the needle to impart crimps, curls and loops to the filaments of the yarn as the yarn passes through the turbulence chamber. To this end, a fluid inlet nipple 24 is fixed at its inner end in one side of the housing 10 (FIG. 1) and the outer end of the nipple 24 is adapted to be connected to any suitable source of pressurized gas or air, not shown. The pressurized air enters the central bore 11 through an air inlet 25, indicated in dotted lines in FIG. 2.

The yarn guiding needle 14 may be supported for longitudinal adjustment in the central bore 11 in any one of a number of ways and is illustrated as being fixed at its outer end to an adjustment cap 26. Adjustment is provided by a shoulder screw 27 which is threadably supported at its inner end in the housing 10 (FIG. 2) and passes through an opening in the adjustment cap 26. The shoulder screw 27 may be rotated so that the needle 14 is adjusted inwardly or outwardly and the air pressure entering the inlet 25 normally maintains the needle 14 in the outermost position with the cap 26 against the enlarged shoulder of the shoulder screw 27.

In threading up the air jet, the cap 26 is manually moved inwardly so that the inner end 15 of the needle 14 is positioned close to the inwardly tapered conical inner end wall 13 of the venturi 12 and the free yarn end of the yarn is positioned adjacent the inlet of the needle so that it is sucked through the jet. When the yarn has been drawn through the jet, the cap 26 is released so that the air pressure forces the needle 14 back to the "run" position, shown in FIG. 2.

Figure 3:
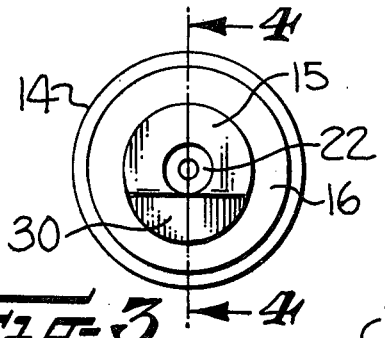
FIG. 3 is an end elevational view looking at the inner end of the yarn guiding needle and illustrating the beveled face formed on the lower portion of the normally flat inner end of the needle.
Figure 5:
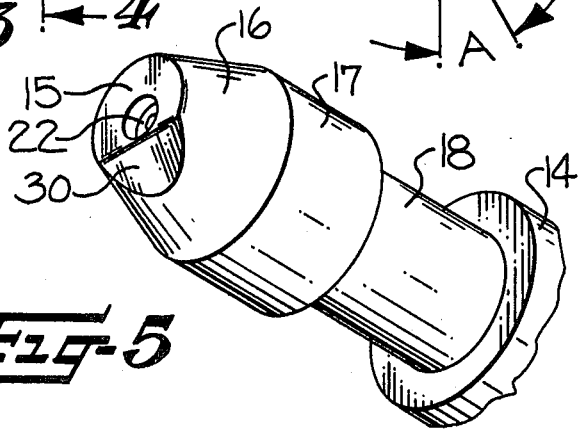
FIG. 5 is a fragmentary isometric view of the inner end of the yarn guiding needle and illustrating the beveled face formed on the inner end of the needle.

In accordance with the present invention, means is provided for enhancing the crimps, curls and loops imparted to the yarn and for permitting increased operational speed of the jet. This is accomplished by increasing the volume of air in an arcuate segment of the restricted airflow passageway into the turbulence chamber so that the greater volume of air enters the turbulence chamber through the arcuate segment of the restricted airflow passageway. In the present instance, this means for increasing the volume of air in an arcuate segment of the restricted airflow passageway comprises a cut-away portion illustrated as a beveled face 30 extending from the flat inner end 15 of the needle and into the inwardly tapered inner end portion 16, as best illustrated in FIGS. 3–5. It has been found that the angle of the beveled face 30, relative to the flat inner end 15, (the angle indicated at A in FIG. 4) can vary between about 20° to 40° and it has been determined that the jet operates most efficiently when the angle is 30°. While the depth of the beveled face 30 may also vary so that the flat upper edge thereof extends across the flat inner end 15 at different positions, it is preferred that the depth of the beveled face 30 be such that the upper edge thereof extends across a minor portion of the inner end 15 of the needle. As shown in FIGS. 3 and 5, the upper edge of the beveled face 30 terminates at the lower edge of the yarn passageway 20.

Also, it has been found that the most efficient texturing is accomplished when the included angle of the inwardly tapered conical end wall 13 of the venturi 12 (indicated at B in FIG. 2) is greater than the included angle of the inwardly tapered inner end portion 16 of the needle 14 (indicated at C in FIG. 4). When the included angle of the inwardly tapered conical inner end wall 13 of the venturi 12 is 60°, it has been found that the included angle of the inwardly tapered inner end portion 16 of the needle 14 should be within the range of from 30° to 50°. The best result is obtained when the included angle is 40°, as shown in FIG. 4.

With an inside diameter of the central bore 11 of 0.4375 of an inch, it has also been found that variations in the diameter of the cylindrical portion 17 of the needle immediately adjacent the inwardly tapered inner end portion 16 makes some difference in the texturing of the yarn. For example, the diameter of the cylindrical portion 17 can vary between 0.315 of an inch and 0.376 of an inch and the best results have been obtained with a diameter of 0.376 of an inch.

The beveled face 30 provides means for increasing the volume of air in the arcuate segment of the restricted airflow passageway so that a greater volume of air enters the turbulence chamber at one side of the needle and provides an "unbalanced" condition in the turbulence chamber. It is believed that this unbalanced condition permits increased operational speeds, enhances the crimps, curls and loops imparted to the yarn, and provides a more efficient use of the air. For example, yarns may be textured with the jet of the present invention at speeds which are increased by about 15 to 30 percent above the speeds at which the same yarns could be textured by the prior jets. In accordance with the present invention, the air flows into the turbulence chamber through the restricted airflow passageway completely surrounding the inner end of the needle but a greater volume of air enters the turbulence chamber in the arcuate segment thereof which is defined by the beveled face 30.

It has been found that the jet of the present invention provides advantages when texturing a wide variety of types and sizes of yarn. For example, the present jet may be used to texture single ends or multiple ends in what is known as a core and effect process.

In the drawings and specification, there has been set forth a preferred embodiment of the invention, and although specific terms are employed, they are used in a generic and descriptive sense only and not for purposes of limitation, the scope of the invention being defined in the claims.

I claim:

1. In a multifilament yarn texturing air jet of the type comprising an elongate housing including a central bore therethrough, venturi means supported in said central bore and at the exit end of said housing and including an inwardly tapered conical inner end wall defining the exit end of a turbulence chamber, a yarn guiding needle concentrically supported in said central bore and including an inner end defining the entrance end of said turbulence chamber, said yarn guiding needle including an inwardly tapered inner end portion extending at least partially into and centered within said inner end wall of said venturi to define a restricted airflow passageway completely surrounding said inner end of said needle, the included angle of said inwardly tapered conical inner end wall of said venturi means being greater than the included angle of said inwardly tapered inner end portion of said needle, a yarn passageway extending through said needle and providing an exit opening in said inner end of said needle, and means for directing pressurized air into said central bore and rearwardly of the inner end of said needle so that the air passes completely around and in a uniform manner along said needle and enters said turbulence chamber through said restricted airflow passageway completely surrounding the inner end of said needle to impart crimps, curls and loops to the filaments of the yarn as the yarn passes through said turbulence chamber, the combination therewith of means for enhancing the crimps, curls and loops imparted to the yarn and for permitting increased operational speed of said jet, said means comprising a cut-away portion on one side only of the inner end of said needle for increasing the volume of air in an arcuate segment on one side only of said restricted airflow passageway so that the air enters said turbulence chamber completely around the inner end of said needle but in an unbalanced condition with the greater volume of air entering said turbulence chamber through said arcuate segment of said restricted airflow passageway, said cut-away portion comprising a beveled face extending across a minor portion of said inner end of said needle, and wherein the remaining portion of said inner end of said needle extends at right angles to the yarn passageway extending through said needle.

2. A yarn texturing air jet according to claim 1 wherein said beveled face extends from said remaining portion of said inner end of said needle at an angle of between 20° to 40°.

3. A yarn texturing air jet according to claim 2 wherein said beveled face extends from said remaining portion of said inner end of said needle at an angle of 30°.

4. A yarn texturing air jet according to claim 1 wherein the included angle of said inwardly tapered conical inner end wall of said venturi means is 60°, and wherein the included angle of said inwardly tapered inner end portion of said needle is within the range of from 30° to 50°.

5. A yarn texturing air jet according to claim 4 wherein the included angle of said inwardly tapered inner end portion of said needle is 40°.

6. A yarn texturing air jet according to claim 1 wherein said central bore of said housing has a diameter of 0.4375 of an inch and wherein the portion of said yarn guiding needle adjacent said inwardly tapered inner end portion has a diameter in the range of from 0.315 of an inch to 0.376 of an inch.

7. A yarn texturing air jet according to claim 6 wherein the portion of said yarn guiding needle adjacent said inwardly tapered inner end portion has a diameter of 0.376 of an inch.

* * * * *